F6966 XR 4,319,879

United States Patent [19]
Hojo et al.
[11] 4,319,879
[45] Mar. 16, 1982

[54] METHOD FOR MODIFYING WOOL FIBER MATERIALS TO ADVANCE QUALITY GRADE THEREOF

[76] Inventors: Hiroshi Hojo, 59-1, Aza Fumizoe, Oaza Ryodakaya, Konan-Shi, Aichi 483; Sadao Noguchi, 85, Narukocho, 4-Chome, Midori-Ku, both of Japan

[21] Appl. No.: 198,946

[22] PCT Filed: Aug. 17, 1979

[86] PCT No.: PCT/JP79/00220

§ 371 Date: May 1, 1980

§ 102(e) Date: Apr. 25, 1980

[87] PCT Pub. No.: WO80/00580

PCT Pub. Date: Apr. 3, 1980

[30] Foreign Application Priority Data

Sep. 1, 1978 [JP] Japan ..... 53-107949

[51] Int. Cl.[3] ..... D06M 3/02; D06M 13/00
[52] U.S. Cl. ..... 8/128 R; 8/108 A
[58] Field of Search ..... 8/128 R, 108 A

[56] References Cited

U.S. PATENT DOCUMENTS 3,628,909 12/1971 Goldberg et al. ..... 8/128 R
3,994,681 11/1976 Hanekom et al. ..... 8/128 R

FOREIGN PATENT DOCUMENTS 2326463 12/1974 Fed. Rep. of Germany .
2613715 4/1977 Fed. Rep. of Germany .
42/5277 3/1967 Japan .
47-20497 9/1972 Japan .
50/42198 4/1975 Japan .

OTHER PUBLICATIONS

Campbell, M. E. and Baumann, H., Textile Research Journal, 1981, 51, (No. 1), pp. 52–54.

*Primary Examiner*—A. Lionel Clingman
*Attorney, Agent, or Firm*—Armstrong, Nikaido, Marmelstein & Kubovcik

[57] ABSTRACT

A method for modifying wool fiber materials to advance quality grade thereof, wherein a wool fiber material is dipped in a saturated solution of a neutral salt of a strong electrolyte and an acid, whereby the acid is included in the edge portions of the endo cuticles of the scales of the wool fiber, and then the wool fiber is dipped in a saturated aqueous solution of the neutral salt having a pH in the neutral range or in water to effect gradual chlorination of the wool fibers, wherein the aqueous solution or the water contains a compound such as sodium hypochlorite, sodium chlorite, chlorocyanuric acid salt and mixtures thereof. The wool fiber is then removed from the saturated aqueous solution, dipped in water to swell the chlorinated portions thereof and washed with water to remove the chlorinated portions. Finally, the thus treated wool is contacted with a solution containing sodium pyrosulfite and an alkaline liquid to provide wool fibers having a smooth surface.

5 Claims, No Drawings

METHOD FOR MODIFYING WOOL FIBER MATERIALS TO ADVANCE QUALITY GRADE THEREOF

TECHNICAL FIELD

By the term "wool fibers" used in the present invention are meant fibers having scales, which have been collected from sheep, goat, llama, alpaca and similar animals.

Wool fibers are composed of aggregates of prosenchymatous cortical cells constituting cortices in the interior of fibers and flat cuticular cells constituting surface layers. The cuticular cells are scaly, and the top ends of these cells project in the form of superimposed edges surrounding cortices to protect them.

In wool fibers, the surface layer extends from the outside toward the interior, and comprises an exo cuticle, an endo cuticle and an epi cuticle surrounding those cuticle. Polar groups are contained in largest quantities in the endo cuticle. The endo cuticles on the inner side of the edge portions of the cuticular cells form a layer which is readily swollen and influenced by absorption of water.

The method for modifying wool fibers to advance the quality grade thereof according to the present invention comprises locally chlorinating edge portions projected in the form of scales on the surfaces of wool fibers, dissolving and removing the chlorinated edge portions by the reducing treatment to smoothen the surfaces of wool fibers, and reinforcing the smoothened surfaces to obtain advanced grade wool fibers having a smooth surface and a good durability.

BACKGROUND ART

As the conventional chlorination process for imparting gloss to wool fibers, there has been tried a method wool fibers are treated in a concentrated aqueous solution of sodium chloride by a mixed acid aqueous solution of a chlorinating agent. In this method, the chlorination is very vigorous, and not only cuticular cells protecting the interiors of wool fibers but also cortical cells are indiscriminately destroyed and the wool fibers are hardened and roughened. Moreover, the mechanical properties are degraded in certain portions and when these fibers are dyed, uneven dyeing is caused because of the difference of the absorbing capacity and the dyed product comes to have a patched appearance. Still further, the fastness is drastically degraded. In short, only damaged fibers are obtained by the above-mentioned conventional chlorination method.

According to the present invention, a necessary amount of an acid is included in the inside of projection scaly edge portions of wool fibers where water is absorbed very uniformly, while other portions are controlled by a saturated solution of a neutral salt so that the acid is not allowed to permeate in these portions, and then, in a chlorinating bath, chlorine is activated by the included acid and chlorination is accomplished only in the limited portions precisely. Therefore, the chlorination method in which all the defects of the conventional method are eliminated is established according to the present invention. At the subsequent reducing and water-washing steps, the surfaces of wool fibers are smoothened. Thus, according to the present invention, wool fibers are modified and the quality grade thereof is advanced by the specific method.

The fact that the endo cuticle of the edge portion has a structure capable of easily adsorbing or absorbing water therein though the surface of the wool fiber is water-repellent is disclosed in the following reference: "Structure of Surface Layer of Wool" compiled by Ryoji Nakamura, in "Crimp, Wool and Technique", No. 33, pages 3 to 9, published on June 30, 1976 by the International Wool Secretary.

DISCLOSURE OF THE INVENTION

The present invention relates to a method for modifying wool fibers to advance the quality grade thereof, which comprises removing edge portions of scales on the surfaces of wool fibers to obtain modified wool fibers having a smooth surface and a good touch. More specifically, according to the present invention, there is provided a modifying technique, by which various properties of wool fibers, such as shine, softness, shrink resistance and dyeability can be improved without degrading basic characteristics of starting wool fibers. For example, baby alpaca fibers, merino wool fibers and tees water wool fibers are modified to fine mohair-like fibers, cashmere-like fibers and mohair-like fibers, respectively, according to the newly developed technique of the present invention. According to the present invention, at first, a wool fiber material is dipped in a saturated solution of a neutral salt such as sodium chloride or Glauber salt, which contains an acid such as hydrochloric acid, sulfuric acid, acetic acid, formic acid, phosphoric acid, monochloroacetic acid or dichloroacetic acid. Since the surface of the wool fiber is highly water-repellent, a saturated solution of such strong electrolyte has no ability to dissolve the surface of the wool fiber. However, on the inner side of the edge portions of scales of the wool fiber there is present the endo cuticle portion containing large quantities of polar groups and including water therein in the ordinary state, and the acid is contained in this portion in the state dissolved in this water. Then, the wool fiber is dipped in a saturated solution of a neutral salt or water containing sodium hypochlorite, sodium chlorite or chlorocyanuric acid salt. In case of sodium hypochloride which is supplied in a highly alkaline state of a pH value of 12 for stabilization, an acid is added to effect neutralization just before dipping and the solution is used in the neutral state, though this preliminary neutralization is not necessary in case of chlorocyanuric acid salt which is dissolved in water to provide a neutral solution. When the wool fiber is thus dipped in the solution of a chlorinating agent such as sodium hypochlorite, sodium chlorite or chlorocyanuric acid salt, chlorine of the chlorinating agent is activated in the acid-containing portion to effect chlorination, but in other portions, chlorination is not caused because these portions are surrounded by the saturated solution of sodium chloride or Glauber salt. Then, the wool fiber is dipped in water, whereby the chlorinated portion is swollen. When the wool fiber is dipped in water containing the chlorinating agent, chlorination and swelling are simultaneously advanced in the acid-containing portion alone. Accordingly, in this case, the reaction is relatively vigorous. Then, the wool fiber is treated with an alkaline solution containing a reducing agent such as sodium pyrosulfite and aqueous ammonia or the like, whereby the unchlorinated residual portions are reduced and dissolved to smoothen the surface of the wool fiber.

BEST MODE FOR CARRYING OUT THE INVENTION

The respective steps of the method for modifying wool fiber materials to advance the quality grade thereof according to the present invention will now be described with reference to the following Examples.

EXAMPLE 1

(1) A wool fiber is dipped in a saturated solution of a neutral salt such as sodium chloride or Glauber salt containing an acid such as hydrochloric acid, sulfuric acid, acetic acid, formic acid, phosphoric acid, monochloroacetic acid or dichloroacetic acid, whereby the acid is contained in the edge portion sensitive to water and capable of being swollen with water in endo cuticles of scales of the wool fiber. The degree of inclusion of the acid is confirmed by the degree of dyeing with Benzyl Purple 4B. The dipping time, acid concentration and temperature are determined according to the desired degree of inclusion of the acid.

(2) Sodium hypochlorite, sodium chlorite or chlorocyanuric acid salt is added to a saturated solution of a neutral acid such as sodium chloride or Glauber salt, and after the pH has been adjusted to 6 to 7, the wool fiber is dipped in this solution. Sodium hypochlorite is ordinarily decomposed according to the following reaction:

$$NaClO = NaCl + O$$

However, since the aqueous solution is saturated with a neutral salt such as sodium chloride (NaCl), NaClO is not decomposed and either NaCl or O is not formed. Therefore, even if NaClO which is ordinarily unstable under neutral conditions is employed, the following reactions are inhibited:

$$2NaClO = NaCl + NAClO_2$$

$$NaClO + NaClO_2 = NaCl + NaClO_3$$

However, if the acid is present, chlorine is promptly formed as shown below:

$$NaClO + HCl = NaCl + HClO$$

$$2HClO = 2HCl + O_2$$

$$HCl + HClO = H_2O + Cl_2$$

Accordingly, chlorination is effected by the acid included in the surface layer and the reaction is very gradually advanced in such a state that chlorine gas is hardly leaked from the surface layer. When water containing such chlorinating agent is used, chlorination is advanced relatively vigorously by the acid contained in the wool fiber to form chlorine.

At this step, the concentration of sodium hypochlorite is adjusted so that the effective chlorine amount is 1 to 13% owf based on the material to be treated.

(3) The liquid is removed from the so treated wool fiber, and the wool fiber is dipped in water, whereby the neutral salt is removed and the chlorinated portion is swollen in the state where it can readily be dissolved out. Then, the swollen portion is mechanically washed away by cold water or warm water maintained at 30° to 40° C.

(4) The remaining portion is treated for 3 to 5 minutes in the following solution:

Sodium pyrosulfite: 10–20 g/l
Aqueous ammonia (25% solution): 14–28 cc/l
Bath ratio: 1:10
Temperature: 25° C.

By this treatment, 95 to 100% of the edge portion is dissolved and the surface of the wool fiber is smoothened.

Then, the dissolved surface portion is washed away by cold water or warm water maintained at 30° to 40° C.

(5) The wool fiber is then treated in a solution containing 3 to 10 cc/l of formalin (37% solution) having a pH adjusted to the neutral level and maintained at 50° to 90° C. for 3 to 60 minutes to reinforce the surface of the wool fiber, and the so treated wool fiber is washed. Thus, the method of the present invention has been completed.

Another embodiment of the present invention will now be described specifically.

EXAMPLE 2

Lincoln wool top having a diameter of 36.5μ is dipped in the following solution at 20° C.:

Sodium chloride (ordinary salt having a sodium chloride content higher than 95%): 0.31 Kg/l
Hydrochloric acid (35% solution): 20 cc/l and is then dyed with 1% of Benzyl Purple 4B and observed by a microscope. It is found that the acid is included in the edge portion of the endo cuticle within about 6 minutes.

Based on results of the above preliminary test, Lincoln wool top is dipped for 6 minutes in the above-mentioned solution containing sodium chloride and hydrochloric acid. Then, the wool fiber is squeezed at a liquid removal ratio of 100% and dipped in the following solution having a pH adjusted to 6.5 by addition of hydrochloric acid:

Sodium chloride: 0.31 Kg/l
Sodium hypochlorite: 3% owf of effective chlorine
Bath ratio: 1:10

The solution is circulated for 10 minutes at 20° to 22° C. The liquid is removed, the edge portion is swollen by cold water and the treated wool fiber is washed with water. Then, the wool fiber is treated at 25° C. for 3 minutes in the following solution:

Sodium pyrosulfite: 10 g/l
Aqueous ammonia (25% solution): 14 cc/l
Bath ratio: 1:10

The liquid is removed and the treated wool is washed with warm water maintained at 35° C. Then, the wool fiber is treated at 80° C. for 30 minutes in the following solution having a pH adjusted to 5 by addition of acetic acid:

Formalin: 3 g/l
Rongalit ($Na_2SO_2.HCHO.2H_2O$): 3 g/l
Bath ratio: 1:10

The treated wool fiber is washed with water and dried. Thus, the treatment method of the present invention has been completed.

The so treated top has a beautiful gloss resembling that of mohair and a very smooth touch. When it is observed by a microscope, the surface condition can hardly be distinguished from that of mohair.

Industrial Applicability

According to the present invention, wool fibers which have heretofore been used for blended products with mohair wool can be modified and there can be obtained high-grade wool fibers which provide loop yarns, woven fabrics and knitted articles which are comparable to those composed of mohair wool alone. Moreover, the modified wool fibers according to the present invention are excellent in various properties such as washing resistance and dyeability.

The present invention can be applied to various kinds of wool fibers and various excellent products can be obtained. Examples are as follows.

(1) When baby alpaca having a diameter of 22μ is treated according to the present invention, there can be obtained a modified wool fiber having a mohair-like appearance and a smooth touch. Although finest mohair naturally available has a diameter of about 24μ, according to the present invention, ultra-high grade mohair-like fiber having a smaller diameter can be obtained by modifying baby alpaca.

(2) When merino wool top of count No. 80 having an average diameter of 17.84μ, produced in Australia, is treated according to the method of the present invention, there can be obtained modified wool having a good touch and free of an itchy touch inherent of wool. A woven fabric or knitted article prepared from this modified wool has a high shrink resistance and a special effect.

(3) When merino wool loose stock having an average diameter of 16.8μ, produced in Australia, is treated according to the method of the present invention using a loose stock dyeing machine or oval wool scouring machine, there can be obtained an excellent modified wool material having appearance and touch comparable to those of cashmere wool.

(4) A worsted yarn of tees water wool having a count number of 18 (International Metric Yarn Count Number) is obtained by spinning and it is treated in the form of a hank according to the method of the present invention using a package type or Smith drum type hank dyeing machine. The resulting modified worsted yarn has substantially the same characteristics as those of a blended worsted yarn containing 80% of kid mohair and it can be used in the same fields as the fields where this blended yarn is actually used.

What is claimed is:

1. A method for modifying wool fibers to advance the quality grade thereof which comprises:

(a) dipping a wool fiber material in a saturated solution of a neutral salt of a strong electrolyte and an acid, whereby the acid is included in the edge portions of the endo cuticles of the scales of the wool fiber;

(b) dipping the wool fiber material in a saturated aqueous solution of the neutral salt having a pH in the neutral range or in water, the aqueous solution or the water containing a compound selected from the group consisting of sodium hypochlorite, sodium chlorite and chlorocyanuric acid salt and mixtures thereof, to effect gradual chlorination of the wool fibers;

(c) removing the liquid from the so-treated wool fiber material;

(d) dipping the wool fiber material in water to swell the chlorinated portions;

(e) washing with water to remove the chlorinated portions; and (f) contacting the resulting wool fiber material with a solution containing sodium pyrosulfite and an alkaline liquid to provide wool fibers having a smooth surface.

2. The method of claim 1 wherein the acid is selected from the group consisting of hydrochloric acid, sulfuric acid, acetic acid, formic acid, phosphoric acid, monochloroacetic acid and dichloroacetic acid.

3. The method of claim 1 wherein the alkaline liquid is aqueous ammonia.

4. The method of claim 1 wherein the neutral salt is sodium chloride or Glauber salt.

5. The method of claim 1 wherein the solution containing a compound selected from the group consisting of sodium hypochlorite, sodium chlorite and chlorocyanuric acid salt has an effective chlorine content in the range of 2–13% owf.

* * * * *